US009316064B2

(12) United States Patent
Patriciu

(10) Patent No.: US 9,316,064 B2
(45) Date of Patent: Apr. 19, 2016

(54) RISER SYSTEM FOR TRANSPORTING A SLURRY FROM A POSITION ADJACENT TO THE SEABED TO A POSITION ADJACENT TO THE SEA SURFACE

(71) Applicant: MARINE RESOURCES EXPLORATION INTERNATIONAL B.V., Laren (NL)

(72) Inventor: Dan Costache Patriciu, Bucharest (RO)

(73) Assignee: Marine Resources Exploration International BV (NL)

( * ) Notice: Subject to any disclaimer, the term of this patent is extended or adjusted under 35 U.S.C. 154(b) by 0 days.

(21) Appl. No.: 14/349,015

(22) PCT Filed: Oct. 2, 2012

(86) PCT No.: PCT/EP2012/004128

§ 371 (c)(1),
(2) Date: Apr. 1, 2014

(87) PCT Pub. No.: WO2013/050138

PCT Pub. Date: Apr. 11, 2013

(65) Prior Publication Data

US 2014/0318803 A1 Oct. 30, 2014

(30) Foreign Application Priority Data

Oct. 3, 2011 (GB) ..... 1116983.6

(51) Int. Cl.
*E21B 7/12* (2006.01)
*E21B 17/01* (2006.01)
(Continued)

(52) U.S. Cl.
CPC ..... *E21B 17/012* (2013.01); *E02F 3/90* (2013.01); *E02F 3/905* (2013.01); *E02F 7/005* (2013.01);
(Continued)

(58) Field of Classification Search
CPC ..... E21B 17/01; E21B 21/001; E21B 43/01; E21B 43/12
USPC ..... 166/367
See application file for complete search history.

(56) References Cited

U.S. PATENT DOCUMENTS 3,588,174 A * 6/1971 Rossfelder et al. ..... 299/8
3,857,651 A 12/1974 Bruno
(Continued)

FOREIGN PATENT DOCUMENTS

EP 2253796 A1 * 11/2010 ..... E21B 43/01
GB 0 196 764 A1 10/1986
(Continued)

OTHER PUBLICATIONS

PCT International Search Report and Written Opinion corresponding to International Application No. PCT/EP2012/004128; Date of mailing of the International Search Report and Written Opinion, Sep. 12, 2013; 13 pages.

*Primary Examiner* — Matthew R Buck
*Assistant Examiner* — Aaron Lembo
(74) *Attorney, Agent, or Firm* — Myers Bigel & Sibley, P.A.

(57) ABSTRACT

A riser system for transporting slurry from the seabed to the sea surface. The riser system comprises a first and second riser, a slurry pump system (17) to transport slurry up one of the risers, and a waste water pump system (107) to return waste water down one of the risers. The slurry pump system and the waste water pump system are selectively connectable to each of the risers to allow each riser to be either a slurry riser (1) or a waste water riser (2). With this arrangement, if a slurry riser develops a leak partway along its length the waste water riser can be converted into a slurry riser such that operation can continue.

19 Claims, 6 Drawing Sheets

(51) Int. Cl.

| | |
|---|---|
| ***E02F 3/90*** | (2006.01) |
| ***E02F 7/00*** | (2006.01) |
| ***E02F 7/10*** | (2006.01) |
| ***E21B 17/18*** | (2006.01) |
| ***E21B 41/00*** | (2006.01) |

(52) U.S. Cl.
CPC . *E02F 7/10* (2013.01); *E21B 17/18* (2013.01); *E21B 41/005* (2013.01); *Y10T 137/0402* (2015.04)

(56) References Cited

U.S. PATENT DOCUMENTS

| | | | | | |
|---|---|---|---|---|---|
| 4,018,483 | A | * | 4/1977 | Smith | 406/108 |
| 4,063,602 | A | | 12/1977 | Howell et al. | |
| 4,141,159 | A | * | 2/1979 | Morris et al. | 37/314 |
| 4,423,983 | A | * | 1/1984 | Dadiras et al. | 405/224.2 |
| 4,780,207 | A | * | 10/1988 | Engwirda | 210/603 |
| 4,813,495 | A | * | 3/1989 | Leach | 175/6 |
| 5,603,171 | A | * | 2/1997 | Steinkuhler | 37/195 |
| 5,650,070 | A | * | 7/1997 | Pollock | 210/612 |
| 6,004,074 | A | * | 12/1999 | Shanks, II | 405/195.1 |
| 6,273,512 | B1 | * | 8/2001 | Rajewski | 299/17 |
| 6,402,430 | B1 | | 6/2002 | Guesnon | |
| 7,591,088 | B1 | * | 9/2009 | Schuh et al. | 37/311 |
| 9,022,128 | B2 | * | 5/2015 | Efthymiou et al. | 166/367 |
| 2003/0024587 | A1 | | 2/2003 | Guesnon et al. | |
| 2003/0074133 | A1 | | 4/2003 | McKinley et al. | |
| 2009/0284068 | A1 | | 11/2009 | Yu et al. | |
| 2011/0309668 | A1 | * | 12/2011 | Efthymiou et al. | 299/17 |
| 2013/0161021 | A1 | | 6/2013 | Makosey et al. | |
| 2013/0312296 | A1 | * | 11/2013 | Jones et al. | 37/317 |
| 2014/0205385 | A1 | * | 7/2014 | Bekker et al. | 406/113 |

FOREIGN PATENT DOCUMENTS

| | | | | |
|---|---|---|---|---|
| WO | WO 2010/092145 | A1 | | 8/2010 |
| WO | WO 2010133564 | A3 | * | 3/2011 |
| WO | WO 2011/122942 | A1 | | 10/2011 |
| WO | WO 2011/156867 | A1 | | 12/2011 |
| WO | WO 2013/012330 | A1 | | 1/2013 |
| WO | WO 2013/059680 | A1 | | 4/2013 |

* cited by examiner

RISER SYSTEM FOR TRANSPORTING A SLURRY FROM A POSITION ADJACENT TO THE SEABED TO A POSITION ADJACENT TO THE SEA SURFACE

RELATED APPLICATIONS

This application is a 35 U.S.C. §371 national stage application of PCT Application No. PCT/EP2012/004128, filed on Oct. 2, 2012, which claims priority from Great Britain Patent Application No. 1116983.6, filed Oct. 3, 2011, the contents of which are incorporated herein by reference in their entireties. The above-referenced PCT International Application was published in the English language as International Publication No. WO 2013/050138 A2 on Apr. 11, 2013.

The present invention relates to a riser system for transporting a slurry from a position adjacent to the seabed to a position adjacent to the sea surface.

In WO 2010/000289 a method and apparatus for mining a seabed is disclosed. This consists of a crawler vehicle for travelling across the seabed, which disturbs sediment and sucks it up. The resultant slurry is then transported up a riser system to a surface vessel for further processing.

The riser system must be able to transport slurry to the surface as reliably as possible as any downtime will represent a significant loss of revenue. At the same time, the riser system is intended to be moved through the sea to follow the crawler vehicle and surface vehicle and therefore needs to be as light and low profile as possible.

The present invention aims to provide a riser system which can operate effectively under these circumstances.

According to a first aspect of the present invention, there is provided a riser system for transporting the slurry from a position adjacent to the seabed to a position adjacent to the sea surface, the riser system comprising first and second risers; a slurry pump system to transport slurry up one of the risers; and a waste water pump system to return waste water down one of the risers; wherein the slurry pump system and the waste water pump system are selectively connectable to each of the risers to allow each riser to be either a slurry riser or a waste water riser.

With this arrangement, if a slurry riser develops a leak partway along its length the waste water riser can be converted into a slurry riser such that operation can continue. Under these circumstances, the leaking slurry riser can be converted into a waste water line as a small leak of water is likely to be acceptable. Alternatively or additionally, one or more additional risers may be present as discussed below. This arrangement provides additional flexibility in production.

Preferably, the system further comprises a third riser to which the slurry pump system and waste water pump system are selectively connectable. This third riser may be in operation in normal use, for example, to act as a second slurry riser. Alternatively, it may be idle. Depending upon which riser has developed a problem, the slurry pump system and water pump system may selectively be connected to the three risers so that the leaking riser is either idle or used for waste water return.

More preferably, there is a fourth riser to which the slurry pump system and waste water pump system are selectively connectable. With four risers, it is possible to have two slurry risers and two waste water risers or two slurry risers, a single waste water riser and an idle riser. Depending upon which riser develops a leak, the system can be reconfigured so that the leaking riser is either idle or becomes one of the waste water risers.

More than four risers may be present to provide additional slurry risers or waste water risers if desired.

The slurry pump may be in the form of a single pump. However, preferably, each slurry pump system consists of a plurality of pumps spaced along the length of the riser.

This forms the second aspect of the present invention which can be defined in its broadest sense as a riser system for transporting a slurry from a position adjacent to the seabed to a position adjacent to the sea surface, the riser system comprising a plurality of risers, each riser comprising a pump system for pumping slurry along the riser; each pump system comprising a plurality of pumps spaced along the riser.

Distributing a number of pumps along the riser in this way allows for known pump technology to be used. The distribution of the weight provides a balanced riser that can more readily be moved through the sea.

The pumps may be grouped towards the top of the riser system, in which case, proven, shallow water pumps can be used. However, this creates a large under-pressure at the top of the riser system which requires thicker walled sections to resist collapse. This leads to heavier system risers and increased costs. Therefore, the pumps are preferably spaced substantially evenly along the riser. This also allows a more 'modular' system in which a shorter riser section with fewer pumps may initially be used to mine shallower waters, to which additional risers with associated pumps may subsequently be added.

Each pump is preferably provided with a pivotal connection to the slurry riser and is arranged such that once pivotally mounted to the slurry riser, pivotal movement about the pivot brings inlet and outlet ports on the pump into engagement with corresponding ports on the riser system. Such a structure allows for a pump to simply be swung into place by an ROV in such a position that, when it is swung into place, the ports on the pump automatically align and mate with the ports on the slurry riser.

In order to facilitate the fixing of a slurry pump onto what was previously a waste water return line, each waste water return line is preferably provided with a site for a pump which has inlet and outlet ports configured to be attachable to the pump, and a bypass pipe removably connected between the inlet and outlet ports. Such a bypass pipe allows water to flow down through the waste water return line when operating in waste water return mode. When it is desired to switch a waste water return line into a slurry riser, the bypass pipe is removed and the pump fixed in place, preferably using the pivotal connection referred to above.

The risers and return lines are preferably connected to one another with a plurality of supports arranged along the length of the riser system with each support being positioned in a substantially horizontal plane. Such a support is well suited to an untethered riser designed to be moved through the sea as it provides reliable and consistent support regardless of the direction of movement and the sea currents.

Each riser or water return line may be a single continuous pipe. Preferably, however, the riser system is made up of a plurality of riser modules each connected end to end to form the slurry risers and water return lines. Each module consists of four ducts, two making up the slurry risers and two making up the water return lines. It should be understood that more than four ducts can be used if required. The description here is just intended to describe the minimum number of ducts necessary. Also, while an even number of ducts are described this is also not necessary as there could be, for example, three risers and two water return lines.

Preferably, two different types of module make up the riser system, namely a duct module which comprises at least four ducts with no lateral ports and a pump module which is similar in construction, except that at least one of the ducts is provided with lateral inlet and outlet ports. These ports may either be connected to a pump in the case of a slurry riser, or may be connected to a bypass pipe in the case of the water return line. Thus, with just two modules, an entire riser system can be built up, with enough pump modules being spaced along the length of the riser to accommodate the desired number of pumps. Indeed, even in the slurry riser, bypass pipes may be connected to some of the inlets and outlets to provide redundancy in the event that additional pumps are required, or that an existing pump needs to be moved.

Preferably, the risers are at least partially suspended from a buoyant tank.

The present invention also extends to a mining system comprising the riser system according to any aspect of the invention above coupled at its top end to a mobile surface vessel and at its bottom end to a mobile subsea mining tool.

According to a further aspect of the present invention there is provided a riser system comprising at least two slurry risers and at least two water return lines, the riser system comprising a plurality of modules connected end-to-end, each module comprising at least a pair of slurry riser ducts and a pair of water return ducts, the modules being selected from a duct module comprising at least four ducts with no lateral ports, and a pump module for which at least one of the ducts has a lateral inlet port and a lateral outlet port for the connection of a pump.

In order to reduce the stresses on the riser caused by the weight of the riser material and slurry, it is desirable to provide buoyancy to the riser.

For a modular construction, some of the modules are provided with buoyancy tanks, and as many of these buoyant modules as necessary are used. This could be implemented by either of the duct or pump modules referred to above being provided with the buoyancy tanks. However, for maximum flexibility, there is preferably a third type of module which will be referred to as a buoyancy module which is provided with buoyancy tanks.

Buoyancy tanks could be provided on the pump module. However, preferably, the buoyancy module is effectively a combination of a duct module and buoyancy tanks. This avoids any potential interference between the lateral ports and the buoyancy tanks.

Preferably, there are as many buoyancy tanks as riser ducts, with the buoyancy tanks being elongate tanks placed between adjacent ducts.

The present invention also extends to a method of configuring a riser system comprising a pair of slurry risers each with a pump system to transport slurry up the riser and a pair of waste water return lines each with a waste water pump to return waste water down the waste water return line, the method comprising disconnecting the waste water pump system from one of the waste water return lines, and connecting the slurry pump system to the waste water return line, thereby turning the waste water return line into a slurry riser. Unless the waste water can be disposed of by some other means, for example, if there is no obligation to return it to the sea bed, the method preferably also comprises disconnecting the pump system from one of the slurry risers, and connecting a waste water pump system to this riser to turn it into a waste water return line.

The riser system is preferably an untethered riser system. This means that it is attached to a moving seabed vehicle rather than being attached to a fixed seabed structure such as a wellhead.

An example of a riser system and method in accordance with the present invention is described with reference to the accompanying drawings, in which.

Figure 1:
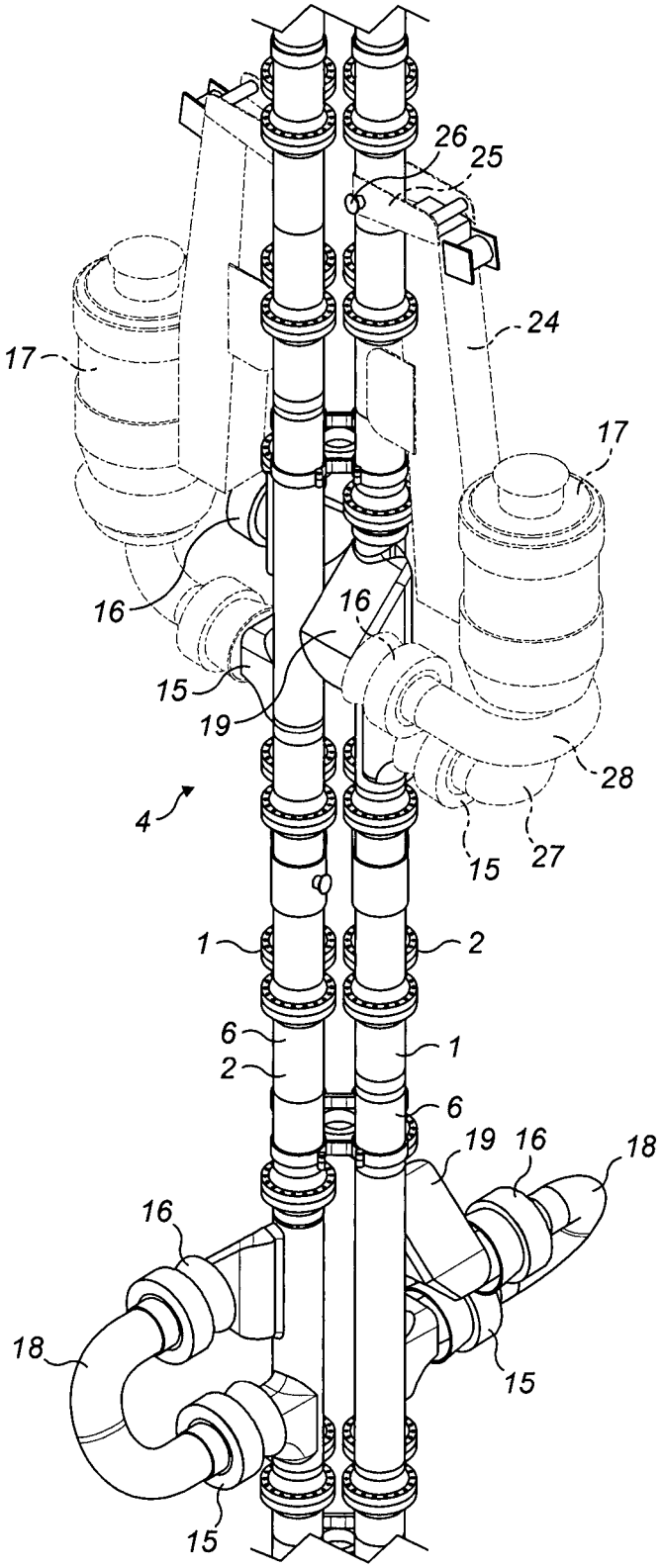
FIG. 1 is a perspective view of a portion of a pump module of the riser system.

The overall system (including the surface vehicle and subsea mining vehicle) are generally described in WO 2010/000289. A schematic view of the overall system is given in FIG. 9.

The overall system comprises a surface vessel 100 at the sea surface 102 and one or more mining vessels 103 which cover the sea bed 4 to pick up a deposit from the sea bed, and form a slurry which is sucked along flexible risers 105. The vehicles are described in pending application (agent's ref. P113709 GB00). The flexible risers 105 are connected by a rotatable ball and socket joint to a respective slurry riser 1 extending down to a position some 200 meters above the seabed. Of note here are the dumping valve 106 which allow the slurry to be dumped from the risers 1 if a problem is encountered. These valves 106 are open on the water return lines for the ejection of water. A diffuser is positioned at the bottom of each riser to reduce the exit velocity of the water. Intermittently along the riser 1 are pumps 17 as described in greater detail below. In parallel with the risers 1 are one or more water return lines 2, (again, described in greater detail below) down which a waste water return pump 107 pumps waste water extracted from the slurry. This can be used to drive the mining vehicles 103. The water return lines have hubs allowing them to be connected to flexible risers 105 if necessary. However, when configured as water return lines, these hubs are blocked. A riser bundle consisting of the risers 1 and waste water return lines 2 are supported in an annular buoyancy tank 108 suspended beneath the surface vessel 100 by a heave compensation system 109. The riser bundle is supported within the tank 108 by radial supports 110. At the top of each riser 1 is a flexible slurry hose (e.g. a rubber dredging hose) 111 connected by a flexible connection and leading via a moon pool to a slurry treatment plant 113. At the top of each water return line 2 is a flexible water return hose 114 connecting via the moon pool 112 to the pump 107. A launch and recovery system 115 for the mining vehicles 103 is provided at the stern of the ship.

Figure 2:
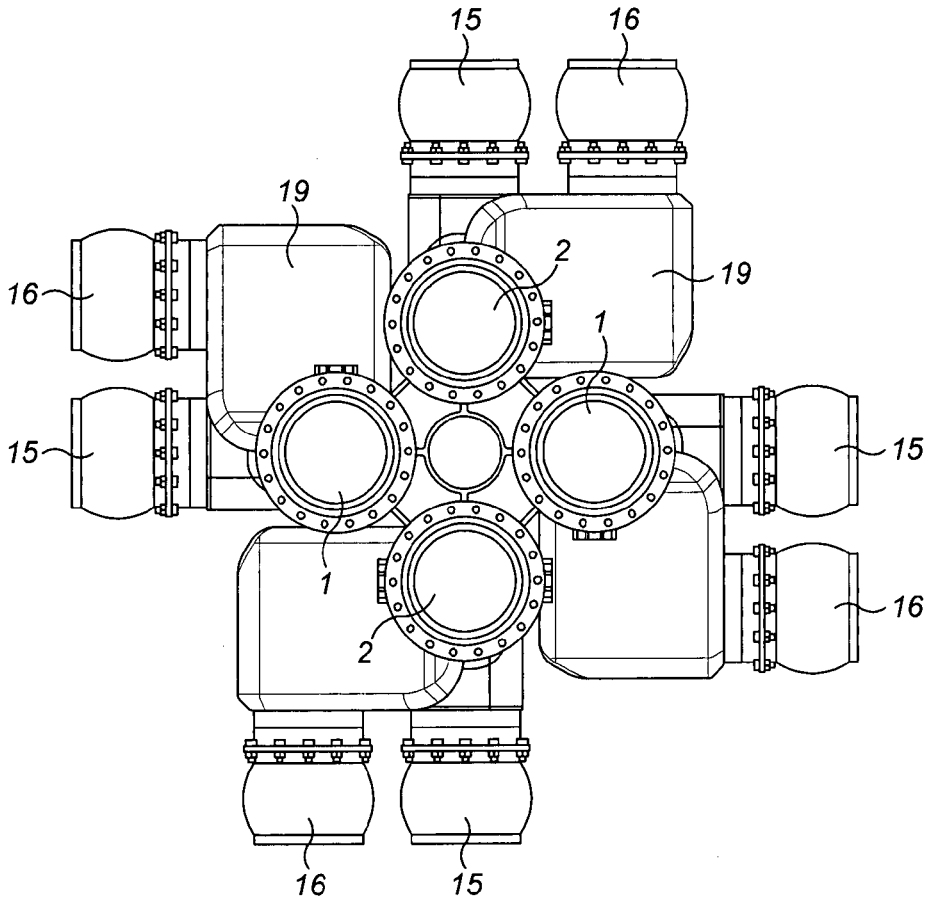
FIG. 2 is a cross-section through the riser system in a horizontal plane with no pumps or bypass valves attached.
Figure 3:
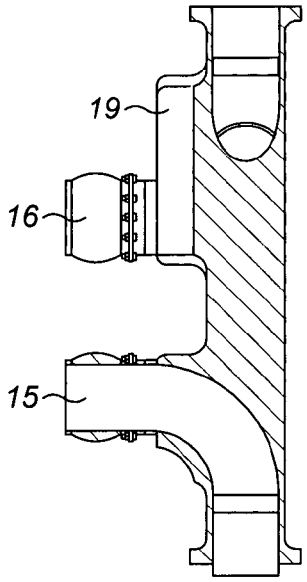
FIG. 3 is a cross-section in a vertical plane of a portion of the riser system containing the inlet and outlet ports.

Turning now to the riser system, this broadly comprises a pair of slurry risers 1 and a pair of waste water return lines 2. These are arranged in a generally square configuration as best shown in FIG. 2 with the pair of slurry risers being opposed to one another and the pair of waste water return lines being opposed to one another. The invention is equally applicable to there being more than two slurry risers or waste water return lines and there is no necessity for these to be in pairs.

Figure 5A:
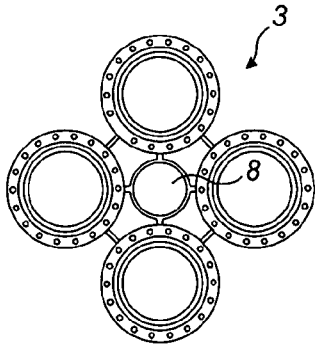
FIGS. 5A, 5B and 5C are a cross-section in a horizontal plane, a side view and a perspective view respectively of a duct module.
Figure 5C:
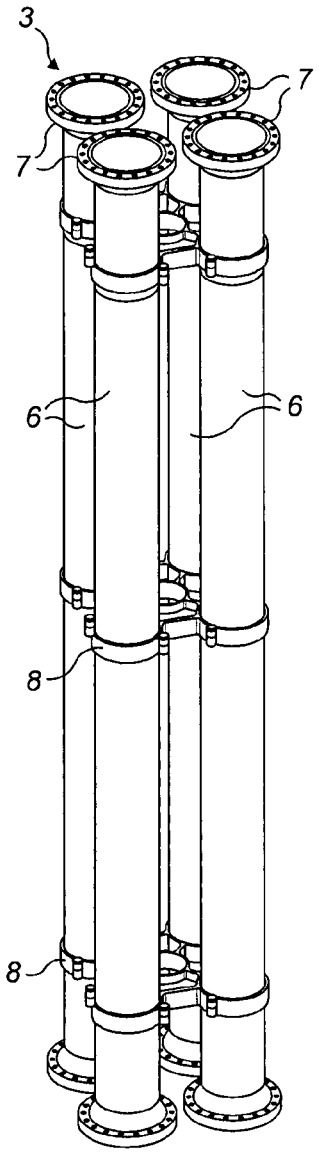
Figure 5B:
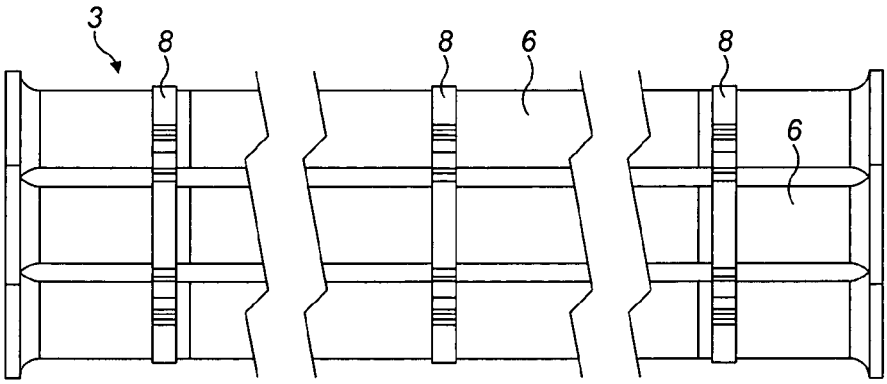

The riser system is made up of a number of modules connected end to end. Three different types of module are used, namely a duct module 3 shown in FIG. 5, a pump module 4 as shown in FIG. 1, and a buoyancy module 5 as shown in FIG. 6.

Individual characteristics of each module will be described in more detail below.

However, each of the modules is provided with a number of common features which are present in the duct module 3. This will now be described, followed by a description of the additional features required for the buoyancy and pump modules.

Each of the modules is made up of four ducts 6 which form the slurry riser 1 or return water line 2 respectively. At the end of each duct is a flange 7 for connection to an adjacent module or to a coupling for an adjacent component in the case of the uppermost and lowermost modules. As can be seen, the flanges are suitable for bolted connections. The four ducts 6 are joined together by a plurality of spaced lateral connectors 8. These have four connected split rings, each split ring being arranged to receive a duct and to be bolted around the duct. The manufacturing tolerances are very tightly controlled to maintain a sufficient contact area between the rings and ducts. The generally symmetrical nature of the design is beneficial as the forces to which the riser is subjected will remain generally constant whatever the direction of travel and sea current.

Figure 6A:
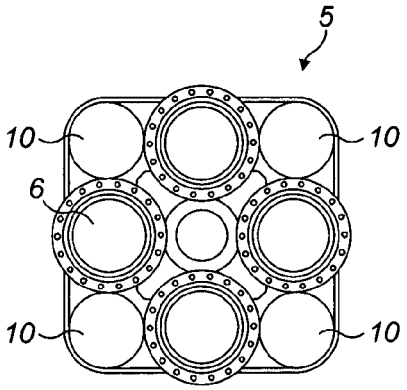
FIGS. 6A, 6B and 6C are similar views of a buoyancy module.
Figure 6C:
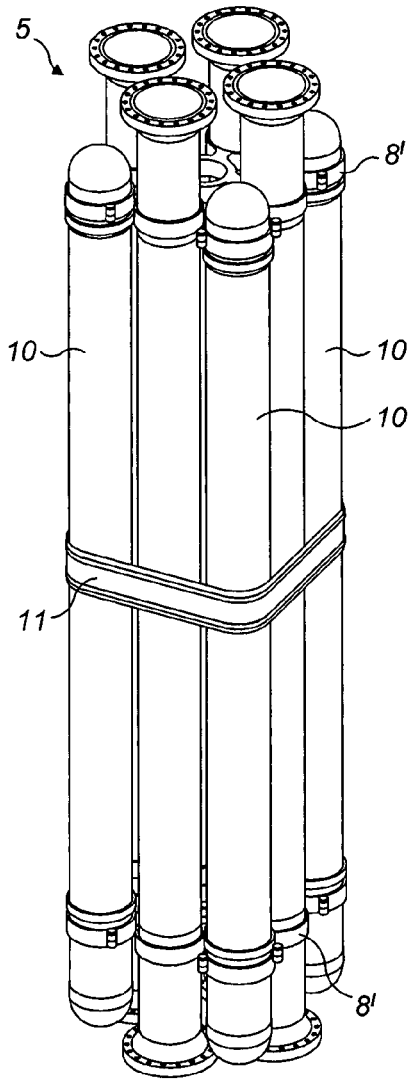
Figure 6B:
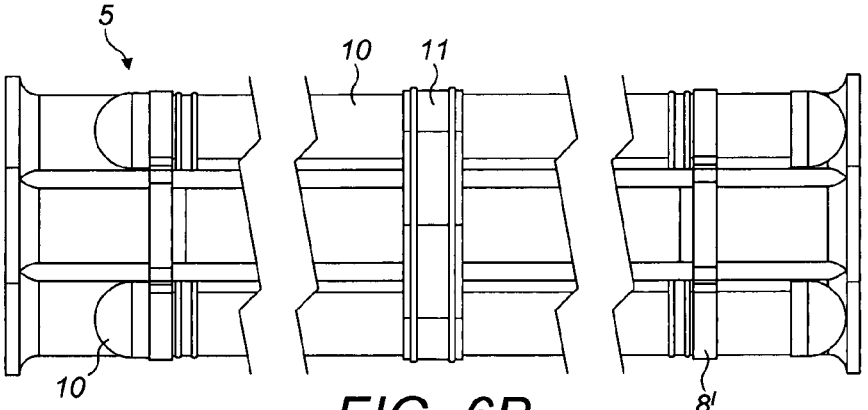
Figure 7C:
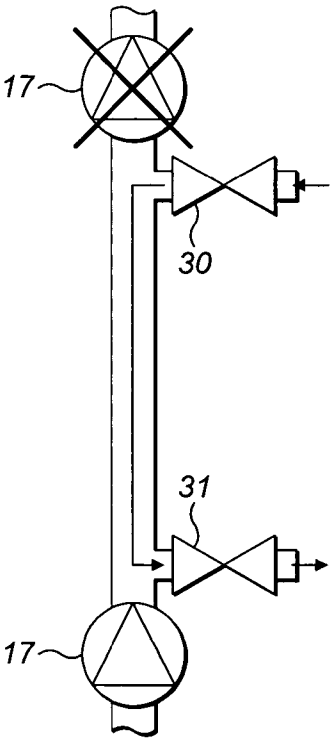
FIGS. 7A-7C are schematic diagrams showing operation of the safety valves.
Figure 7B:
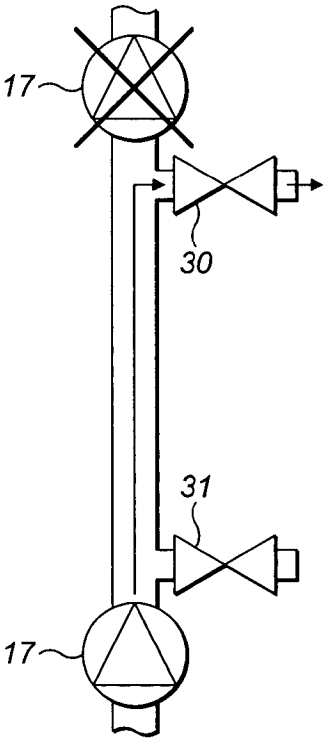
Figure 7A:
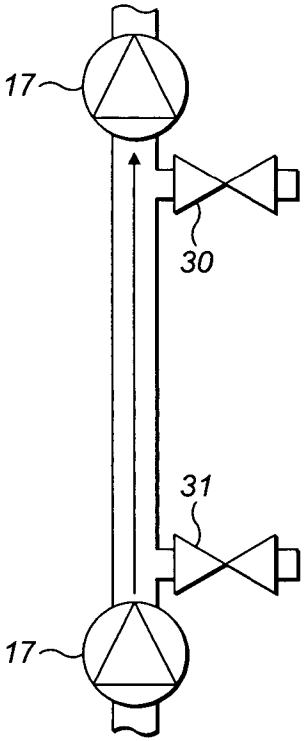

The buoyancy module 5 is essentially the same as the riser module 3, except that this is provided with a plurality of buoyancy capsules 10 as shown in FIGS. 6A and 6C. Four such capsules 10 are provided for each module and are nested between each pair of risers 1 and return lines 2 to provide the compact configuration shown in FIG. 6A. As shown in FIG. 6C, the capsules 10 stop short of the flanges 7 so that they do not interfere with the connection between adjacent modules. A modified connector 8' can be used which is similar to the connector 8, but is provided with additional split rings to receive the capsules 10. In addition, one or more bands 11, for example of titanium and neoprene rubber, may be wrapped around the bundle in order to provide enhanced stability.

The pump module 4 will now be described with reference to FIGS. 1 to 4.

The basic structure of the module is the same as the riser module described above with added enhancement to allow for the attachment of an interchangeable pump set. Each duct 6 on the module is provided with a pair of lateral ports, namely an outlet port 15 and an inlet port 16 above the outlet port 15.

The designation of a port at an outlet port 15 means that this is a port out of which the slurry flows into the pump 17 when the riser is configured as the slurry riser. Similarly, the inlet port 16 is the port through which slurry flows back into the duct 6 from the pump 17 again when the riser is configured as a slurry riser. When the riser is configured as a waste water return line 2, the flow is reversed such that the flow is actually out of the inlet port 16 into a bypass duct 18 connected between ports 15 and 16 and back into the riser via the outlet port 15. However, for consistency of terminology, the ports will be referred to as outlet port 15 and inlet port 16 if they were in the pump configuration.

As can be seen most clearly from FIG. 2, the outlet ports 15 are in line with the ducts 6. However, the inlet ports 16 are laterally off-set from the ducts 6 via inlet manifolds 19. This allows access to the lower outlet port 15 from above without interference from the inlet port 16.

The pumps 17 are centrifugal dredging pumps. The pumps are driven by an electric motor. The pumps have a typical flow of 4.00 $m^3/s$ and a head of 478 kpa.

The pump and motor are built together in a support frame 24 to form a module. A gland pump and an oil pressure compensation system are fitted on the pump frame 24. Each pump has its own individual umbilical for control and monitoring. Each umbilical is stored on an individual umbilical handling winch installed on the deck of the surface vessel. The pump speed is controlled using frequency drives which are mounted on the production vessel.

As the pumps are in deep water, cavitation is not considered to be a problem. However, small gas pockets may cause a slight reduction in pumping efficiency. Speed control of each individual pump is regulated from the surface by varying the frequency using a frequency drive. The performance, load and condition of each pump and motor are monitored by sensors for speed, pump pressure on suction and pressure sides, pump vibrations, oil compensation tank level, motor temperature and motor vibrations. Sensor signals are passed through the motor umbilical.

As an alternative to the electric centrifugal pump, the riser pumps can for example be mechanically driven centrifugal pumps or pump drive systems based on water hydraulics.

Figure 4:
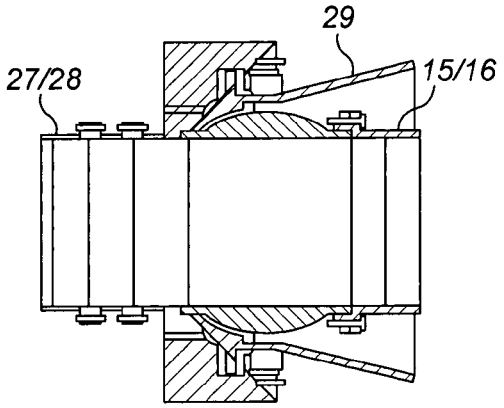
FIG. 4 is a cross-section through the interface between an inlet/outlet port and a pump.

The pump frame 24 is provided at its upper end with a hook 25. The pump frame 24 is lowered in place on a wire line so that the hook 25 engages with a pivot 26 on the duct 6. The pump is then swung into place so that a pump inlet duct 27 which leads to a pump inlet, and a pump outlet duct 28 which leads from a tangential pump outlet meet with the pump outlet port 15 and inlet port 16 respectively as shown in FIG. 4. The ports 15/16 have a generally spherical section, while the respective inlet/outlet ducts 27/28 have a flared end portion 29 to accommodate any small misalignment which may occur between the pump 17 and duct 6. The connection is also provided with rubber sealing elements. The pump module has an ROV docking station to allow the module to be steered by ROV thruster force for positioning. The pump modules are lifted on a wire using a heave compensated crane. A connection/disconnection of the wire and the connection/disconnection of the couplings are assisted by the ROV.

The waste water pumps take the form of a set of electrically driven centrifugal pumps 107 on the deck of the surface vessel 100 which are used to pump the water in the waste water return risers 2. When the waste water return line is converted for use as a slurry riser, these pumps 107 are disconnected from the existing flexible water hose 114 and are connected to whichever duct will subsequently be used as the waste water return line.

In order to construct the riser system, riser sections are deployed from a crane vertically one by one from the deck handling facility on the surface vessel. Each section is supported vertically while it is joined to the section below. The combined structure is weighted and is lowered through the moon pool. Each riser section should have a length and weight suitable for handling in the deck area. The length of each section is typically 12 to 18 meters long with the maximum handling weight being defined by the ships handling facility. As the riser length increases as it is lowered into the sea, the deployment hook load is reduced by the presence of buoyancy modules 5.

The completed riser bundle is hung off a floatation tank 108 which carries most of its weight. This tank is in turn, is supported by a heave compensation system 109 to the production vessel. The floatation tank is fitted with an active ballast compensation system and a thruster to allow rotation of the whole riser system around its vertical axis to align the riser with the derrick centre line and to control the tank heading during operation. Once the riser system has been turned into the correct angular position, the pumps are installed as set out above. The floatation tank 108 is compartmentalised to provide some protection against leakage or damage and is compressed air ballasted. The buoyancy can be controlled using water injection but the tank is designed such that it can never be buoyant enough to allow the tank to surface.

In order to start up the system, the riser and pumps are flooded with sea water. All pumps, including those on the subsea vehicle are slowly increased in speed until the vehicle begins to suck a slurry. The control system for the centrifugal pumps registers the pump load and controls the speed of each pump individually to pump the slurry in the most effective way during the start up period when the slurry density slowly increases.

Should one pump 17 fail, it will generally be the case that the remaining pumps in that riser cannot generate enough head to pump the slurry to the surface. This means that production in the affected riser stops. The effective riser has to be flushed with clean sea water to allow replacement of the failed pump. After flushing, the pump can be replaced and pumping can commence.

To allow riser flushing, a series of control valves are installed in the riser. Riser flushing at pump failure is described below.

When regular maintenance is necessary, this can be avoided by flushing a riser by running the subsea vehicle to produce only clean sea water. As the slurry density slowly reduces, the remaining pumps in the riser should be able to flush the riser from top to bottom. To ease this process, the pumps will have a sufficiently high power rating to allow the slurry to be pumped while the failed centrifugal pump remains in location.

Centrifugal dredging pumps have a relatively flat operating curve making them tolerant to slurry density variations. Variations in slurry density will occur continuously during production as a result of variations of layer structure, variations of in situ densities, the speed of the subsea vehicle, the manoeuvring of the subsea vehicle and variations caused by variations in the configuration of the vehicle.

As the impellers 22 used in the pumps have a fairly large passage, even large particles, such as gas hydrates, will easily pass. The dredge pumps are specifically designed for this as such particles in dredged slurries are common in the dredging industry. The lowest pump in the riser tends to break the larger parts of hydrates on impact. As the pumps are distributed over the water depth, the main pressure in the riser will be less compared to a system with all of the pumps at the bottom of the riser. This means that any gas hydrates entering the system will start dissociating under the influence of the reducing pressure during the assent to the surface. This dissociation may be accelerated by the fact that all particles have a large surface area to volume ratio.

Figure 8:
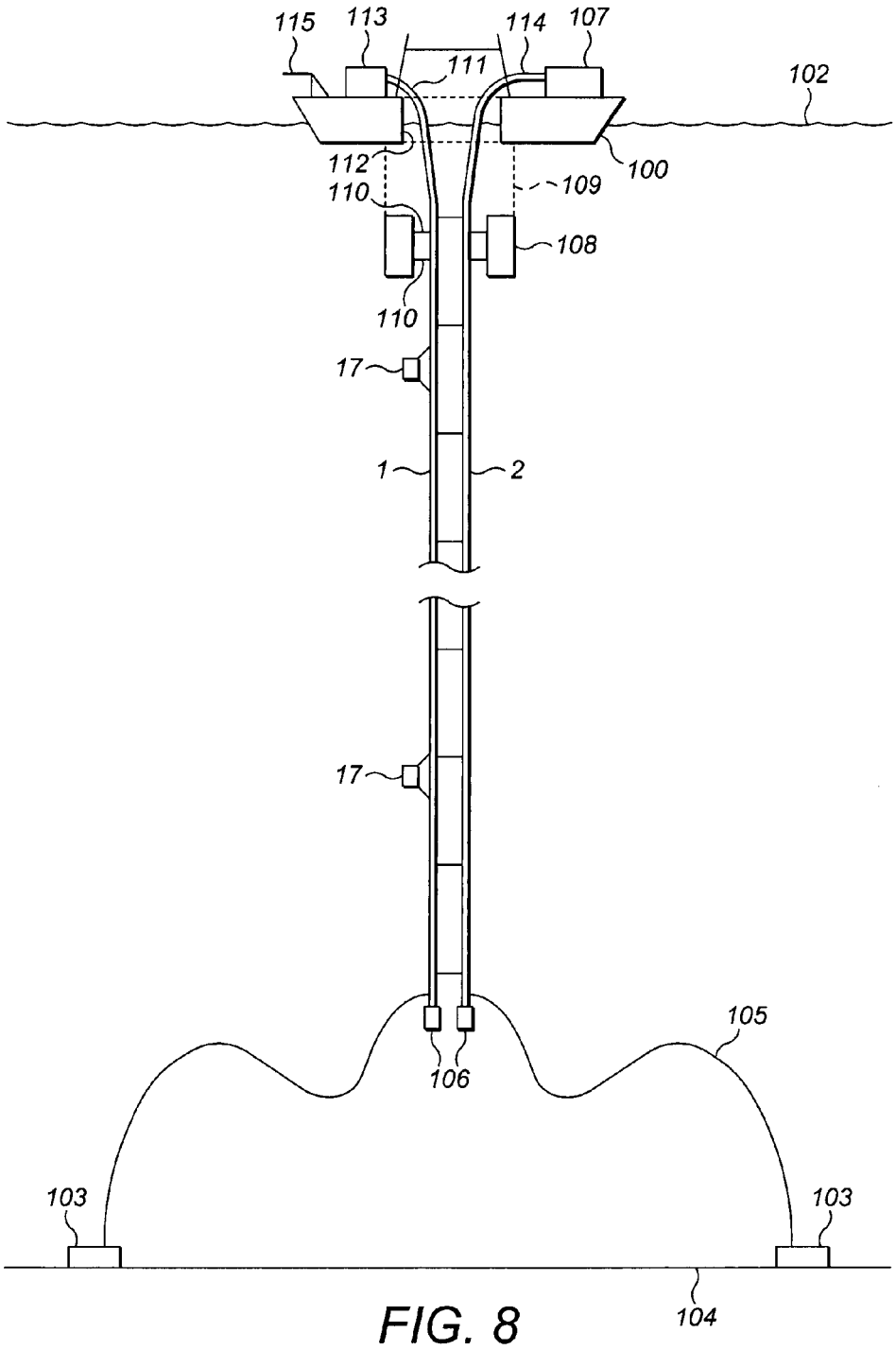
FIG. 8 is a schematic diagram of the whole mining system.

Before and after every pump, a safety valve 30, 31 is fitted as shown in FIGS. 8A-8C. During normal operation both safety valves 30, 31 are closed (FIG. 8A). When a pump is blocked, the safety valve before the pump is used to avoid the impulse of the slurry creating an overpressure (FIG. 8B). When the slurry speed becomes too low due to improper functioning of the pumps, the safety valves and pump are opened so that the slurry will not settle in the riser (FIG. 8C). The safety valve before the pump is used to avoid under pressure in the riser in that case. In effect, the safety valves are used to empty the riser to avoid under or over pressure in the riser.

The riser under/over pressure is monitored and controlled through a combination of varying individual pump speeds at the operation of the in-line safety valves. In conjunction with this, any variants in the riser buoyancy due to variability in the slurry density occurring in the riser is controlled through a combination of the compensation system and floatation tank referred to above to maintain a stable buoyancy.

The invention claimed is:

1. A riser system for transporting a slurry from a position adjacent to a seabed to a position adjacent to a sea surface, the riser system comprising:

a plurality of risers;

a slurry pump system to transport slurry up a first one of the risers; and a waste water pump system to return waste water down a second one of the risers;

wherein the slurry pump system and the waste water pump system are selectively connectable to each of the risers to allow each riser to be either a slurry riser or a waste water riser.

2. The riser system of claim 1, further comprising a third riser to which the slurry pump system and the waste water pump system are selectively connectable.

3. The riser system of claim 2, further comprising a fourth riser to which the slurry pump system and the waste water pump system are selectively connectable.

4. The riser system of claim 1, wherein the slurry pump system comprises a plurality of pumps spaced along a length of the first one of the risers.

5. The riser system of claim 1, wherein the risers are connected to one another with a plurality of supports arranged along the length of the riser system with each support being positioned in a substantially horizontal plane.

6. The riser system of claim 1, wherein the riser system comprises a plurality of riser modules each connected end to end to form the risers.

7. The riser system of claim 6, wherein the riser system comprises two different types of modules, including a duct module which comprises at least four ducts with no lateral ports and a pump module which comprises at least four ducts, at least one of which is provided with lateral inlet and outlet ports.

8. The riser system of claim 6, wherein some of the modules are provided with buoyancy tanks.

9. The riser system of claim 1, further comprising a buoyant tank from which the risers are at least partially suspended.

10. A mining system comprising:

a riser system according to claim 1 coupled at a top end thereof to a mobile surface vessel and at a bottom end thereof to a mobile subsea mining tool.

11. A riser system for transporting a slurry from a position adjacent to a seabed to a position adjacent to a sea surface, the riser system comprising:

a plurality of slurry risers, each slurry riser comprising a pump system for pumping slurry along the riser;

each pump system comprising a plurality of pumps spaced along the slurry riser;

wherein each pump is provided with a pivotal connection to the slurry riser and is arranged such that once pivotally mounted to the slurry riser, pivotal movement about the pivotal connection brings inlet and outlet ports on the pump into engagement with corresponding ports on the riser system.

12. The riser system of claim 11, further comprising a plurality of wastewater return lines, wherein each waste water return line is provided with a site for a waste water pump which has inlet and outlet ports configured to be attachable to the waste water pump, and a bypass pipe removably connected between the inlet and outlet ports.

13. The riser system of claim 11, wherein the risers are connected to one another with a plurality of supports arranged along the length of the riser system with each support being positioned in a substantially horizontal plane.

14. The riser system of claim 11, wherein the riser system comprises a plurality of riser modules each connected end to end to form the slurry risers.

15. The riser system of claim 14, wherein the riser system comprises two different types of modules, including a duct module which comprises at least four ducts with no lateral ports and a pump module which comprises at least four ducts, at least one of which is provided with lateral inlet and outlet ports.

16. The riser system of claim 11, further comprising a buoyant tank from which the risers are at least partially suspended.

17. A mining system comprising:

a riser system according to claim 11 coupled at a top end to a mobile surface vessel and at a bottom end to a mobile subsea mining tool.

18. A method of configuring a riser system comprising a pair of slurry risers each with a pump system to transport slurry up the riser and a pair of waste water return lines each with a waste water pump to return waste water down the waste water return line, the method comprising:

disconnecting the waste water pump system from one of the waste water return lines, and connecting the slurry pump system to the waste water return line, thereby turning the waste water return line into a slurry riser.

19. The method of claim 18, the method also comprising:

disconnecting the pump system from one of the slurry risers, and connecting a waste water pump system to the one of the slurry risers to turn it into a waste water return line.

* * * * *